US007587980B2

(12) United States Patent
Rastegar et al.

(10) Patent No.: US 7,587,980 B2
(45) Date of Patent: Sep. 15, 2009

(54) MECHANICAL DELAY MECHANISMS FOR INERTIAL IGNITERS FOR THERMAL BATTERIES AND THE LIKE

(75) Inventors: Jahangir S. Rastegar, Stony Brook, NY (US); Richard Murray, Sayville, NY (US); Thomas Spinelli, East Northport, NY (US)

(73) Assignee: Omnitek Partners LLC

( * ) Notice: Subject to any disclaimer, the term of this patent is extended or adjusted under 35 U.S.C. 154(b) by 0 days.

(21) Appl. No.: 11/888,814

(22) Filed: Aug. 2, 2007

(65) Prior Publication Data

US 2008/0041262 A1 Feb. 21, 2008

Related U.S. Application Data

(60) Provisional application No. 60/835,023, filed on Aug. 2, 2006.

(51) Int. Cl.
*F42C 15/24* (2006.01)

(52) U.S. Cl. ..... 102/253; 102/247; 102/216; 102/231; 102/234

(58) Field of Classification Search ..... 102/216, 102/231, 234, 247, 252, 253, 222, 249, 251, 102/254, 256
See application file for complete search history.

(56) References Cited

U.S. PATENT DOCUMENTS 559,495 A * 5/1896 Rapieff ..... 102/247
2,243,621 A * 5/1941 Denoix ..... 102/253
2,977,882 A * 4/1961 Jasse ..... 102/248
3,118,378 A * 1/1964 Jasse ..... 102/250
3,425,351 A * 2/1969 Fyfe ..... 102/207
3,814,018 A * 6/1974 Daniel ..... 102/253
3,842,740 A * 10/1974 Mirlesse ..... 102/487
4,212,245 A * 7/1980 Rusbach ..... 102/249
4,320,706 A * 3/1982 Rusbach ..... 102/249
4,449,455 A * 5/1984 Halssig ..... 102/234
4,487,127 A * 12/1984 Luebbers ..... 102/253
4,969,397 A * 11/1990 Gunther et al. ..... 102/233
4,991,510 A * 2/1991 Lubbers ..... 102/247
5,467,713 A * 11/1995 Roosmann et al. ..... 102/233
5,872,324 A * 2/1999 Watson et al. ..... 102/265
6,279,480 B1 * 8/2001 Roosmann ..... 102/272
6,536,347 B1 * 3/2003 Zacharin ..... 102/274
2008/0110365 A1 * 5/2008 Rastegar et al. ..... 102/204

* cited by examiner

*Primary Examiner*—Bret Hayes
*Assistant Examiner*—Michael D David

(57) ABSTRACT

An inertia igniter including: a housing; and a movable striker supported by first and second stages, the first stage having a first locking element for releasing the second stage upon a first predetermined acceleration of the housing and the second stage having a second locking element for releasing the striker upon a second predetermined acceleration of the housing greater than the first predetermined acceleration. Wherein the first and second locking elements of the first and second stages occupy a common cross-sectional volume along a longitudinal axis of the housing.

2 Claims, 6 Drawing Sheets

MECHANICAL DELAY MECHANISMS FOR INERTIAL IGNITERS FOR THERMAL BATTERIES AND THE LIKE

CROSS-REFERENCE TO RELATED APPLICATIONS

The present application claims priority to U.S. provisional patent application Ser. No. 60/835,023, filed on Aug. 2, 2006, the entire contents of which is incorporated herein by reference.

GOVERNMENT RIGHTS

This invention was at least partially made with Government support under Contract No. W15QKN-07-C-0042, awarded by the U.S. Army. The Government may have certain rights in this invention.

BACKGROUND OF THE INVENTION

1. Field of the Invention

The present invention relates generally to mechanical acceleration delay mechanisms, and more particularly for inertial igniters for thermal batteries used in gun-fired munitions and other similar applications.

2. Prior Art

Thermal batteries represent a class of reserve batteries that operate at high temperatures. Unlike liquid reserve batteries, in thermal batteries the electrolyte is already in the cells and therefore does not require a distribution mechanism such as spinning. The electrolyte is dry, solid and non-conductive, thereby leaving the battery in a non-operational and inert condition. These batteries incorporate pyrotechnic heat sources to melt the electrolyte just prior to use in order to make them electrically conductive and thereby making the battery active. The most common internal pyrotechnic is a blend of Fe and $KClO_4$. Thermal batteries utilize a molten salt to serve as the electrolyte upon activation. The electrolytes are usually mixtures of alkali-halide salts and are used with the Li(Si)/$FeS_2$ or Li(Si)/$CoS_2$ couples. Some batteries also employ anodes of Li(Al) in place of the Li(Si) anodes. Insulation and internal heat sinks are used to maintain the electrolyte in its molten and conductive condition during the time of use. Reserve batteries are inactive and inert when manufactured and become active and begin to produce power only when they are activated.

Thermal batteries have long been used in munitions and other similar applications to provide a relatively large amount of power during a relatively short period of time, mainly during the munitions flight. Thermal batteries have high power density and can provide a large amount of power as long as the electrolyte of the thermal battery stays liquid, thereby conductive. The process of manufacturing thermal batteries is highly labor intensive and requires relatively expensive facilities. Fabrication usually involves costly batch processes, including pressing electrodes and electrolytes into rigid wafers, and assembling batteries by hand. The batteries are encased in a hermetically-sealed metal container that is usually cylindrical in shape. Thermal batteries, however, have the advantage of very long shelf life of up to 20 years that is required for munitions applications.

Thermal batteries generally use some type of igniter to provide a controlled pyrotechnic reaction to produce output gas, flame or hot particles to ignite the heating elements of the thermal battery. There are currently two distinct classes of igniters that are available for use in thermal batteries. The first class of igniter operates based on electrical energy. Such electrical igniters, however, require electrical energy, thereby requiring an onboard battery or other power sources with related shelf life and/or complexity and volume requirements to operate and initiate the thermal battery. The second class of igniters, commonly called "inertial igniters", operates based on the firing acceleration. The inertial igniters do not require onboard batteries for their operation and are thereby often used in high-G munitions applications such as in gun-fired munitions and mortars.

In general, the inertial igniters, particularly those that are designed to operate at relatively low impact levels, have to be provided with the means for distinguishing events such as accidental drops or explosions in their vicinity from the firing acceleration levels above which they are designed to be activated. This means that safety in terms of prevention of accidental ignition is one of the main concerns in inertial igniters.

In recent years, new improved chemistries and manufacturing processes have been developed that promise the development of lower cost and higher performance thermal batteries that could be produced in various shapes and sizes, including their small and miniaturized versions. However, the existing inertial igniters are relatively large and not suitable for small and low power thermal batteries, particularly those that are being developed for use in miniaturized fuzing, future smart munitions, and other similar applications.

A schematic of a cross-section of a thermal battery and inertial igniter assembly of the prior art is shown in FIG. 1. In thermal battery applications, the inertial igniter 10 (as assembled in a housing) is either positioned above the thermal battery housing 11 as shown in FIG. 1 or within the thermal battery itself (not shown). When positioned outside the thermal battery as shown in FIG. 1, upon ignition, the igniter initiates the thermal battery pyrotechnics positioned inside the thermal battery through a provided access 12. The total volume that the thermal battery assembly 16 occupies within munitions is determined by the diameter 17 of the thermal battery housing 11 (assuming it is cylindrical) and the total height 15 of the thermal battery assembly 16. The height 14 of the thermal battery for a given battery diameter 17 is generally determined by the amount of energy that it has to produce over the required period of time. For a given thermal battery height 14, the height 13 of the inertial igniter 10 would therefore determine the total height 15 of the thermal battery assembly 16. To reduce the total volume that the thermal battery assembly 16 occupies within a munitions housing, it is therefore important to reduce the height of the inertial igniter 10. This is particularly important for small thermal batteries since in such cases the inertial igniter height with currently available inertial igniters can be almost the same order of magnitude as the thermal battery height. When the inertial igniter is positioned inside the thermal battery itself, the total volume of the igniter must be reduced to minimally add to the total volume of the thermal battery.

With currently available inertial igniters of the prior art (e.g., produced by Eagle Picher Technologies, LLC), a schematic of which is shown in FIG. 2, the inertial igniter 20 has to be positioned within a housing 21 as shown in FIG. 3. The housing 21 and the thermal battery housing 11 may share a common cap 22, with the opening 25 to allow the ignition fire to reach the pyrotechnic material 24 within the thermal battery housing. As the inertial igniter is initiated, the sparks can ignite intermediate materials 23, which can be in the form of thin sheets to allow for easy ignition, which would in turn ignite the pyrotechnic materials 24 within the thermal battery through the access hole 25.

A schematic of a cross-section of a currently available inertial igniter 20 is shown in FIG. 2 in which the acceleration is in the upward direction (i.e., towards the top of the paper). The igniter has side holes 26 to allow the ignition fire to reach the intermediate materials 23 as shown in FIG. 3, which necessitate the need for its packaging in a separate housing, such as in the housing 21. The currently available inertial igniter 20 is constructed with an igniter body 60. Attached to the base 61 of the housing 60 is a cup 62, which contains one part of a two-part pyrotechnic compound 63 (e.g., potassium chlorate). The housing 60 is provided with the side holes 26 to allow the ignition fire to reach the intermediate materials 23 as shown in FIG. 3. A cylindrical shaped part 64, which is free to translate along the length of the housing 60, is positioned inside the housing 60 and is biased to stay in the top portion of the housing as shown in FIG. 2 by the compressively preloaded helical spring 65 (shown schematically as a heavy line). A turned part 71 is firmly attached to the lower portion of the cylindrical part 64. The tip 72 of the turned part 71 is provided with cut rings 72*a*, over which is covered with the second part of the two-part pyrotechnic compound 73 (e.g., red phosphorous).

A safety component 66, which is biased to stay in its upper most position as shown in FIG. 2 by the safety spring 67 (shown schematically as a heavy line), is positioned inside the cylinder 64, and is free to move up and down (axially) in the cylinder 64. As can be observed in FIG. 2, the cylindrical part 64 is locked to the housing 60 by setback locking balls 68. The setback locking balls 68 lock the cylindrical part 64 to the housing 60 through holes 69*a* provided on the cylindrical part 64 and the housing 60 and corresponding holes 69*b* on the housing 60. In the illustrated configuration, the safety component 66 is pressing the locking balls 68 against the cylindrical part 64 via the preloaded safety spring 67, and the flat portion 70 of the safety component 66 prevents the locking balls 68 from moving away from their aforementioned locking position. The flat portion 70 of the safety component 66 allows a certain amount of downward movement of the safety component 66 without releasing the locking balls 68 and thereby allowing downward movement of the cylindrical part 64. For relatively low axial acceleration levels or higher acceleration levels that last a very short amount of time, corresponding to accidental drops and other similar situations that cause safety concerns, the safety component 66 travels up and down without releasing the cylindrical part 64. However, once the firing acceleration profiles are experienced, the safety component 66 travels downward enough to release balls 68 from the holes 69*b* and thereby release the cylindrical part 64. Upon the release of the safety component 66 and appropriate level of acceleration for the cylindrical part 64 and all other components that ride with it to overcome the resisting force of the spring 65 and attain enough momentum, then it will cause impact between the two components 63 and 73 of the two-part pyrotechnic compound with enough strength to cause ignition of the pyrotechnic compound.

The aforementioned currently available inertial igniters have a number of shortcomings for use in thermal batteries, specifically, they are not useful for relatively small thermal batteries for munitions with the aim of occupying relatively small volumes, i.e., to achieve relatively small height total igniter compartment height 13 (FIG. 1). Firstly, the currently available inertial igniters, such as that shown in FIG. 2 are relatively long thereby resulting in relatively long total igniter heights 13. Secondly, since the currently available igniters are not sealed and exhaust the ignition fire out from the sides, they have to be packaged in a housing 21, usually with other ignition material 23, thereby increasing the height 13 over the length of the igniter 20 (FIG. 3). In addition, since the pyrotechnic materials of the currently available igniters 20 are not sealed inside the igniter, they are prone to damage by the elements and cannot usually be stored for long periods of time before assembly into the thermal batteries unless they are stored in a controlled environment.

SUMMARY OF THE INVENTION

Accordingly, an inertia igniter is provided. The inertia igniter including: a housing; and a movable striker supported by first and second stages, the first stage having a first locking element for releasing the second stage upon a first predetermined acceleration of the housing and the second stage having a second locking element for releasing the striker upon a second predetermined acceleration of the housing greater than the first predetermined acceleration. Wherein the first and second locking elements of the first and second stages occupy a common cross-sectional volume along a longitudinal axis of the housing.

BRIEF DESCRIPTION OF THE DRAWINGS

These and other features, aspects, and advantages of the apparatus of the present invention will become better understood with regard to the following description, appended claims, and accompanying drawings where:

DETAILED DESCRIPTION OF THE PREFERRED EMBODIMENT

Figure 1:
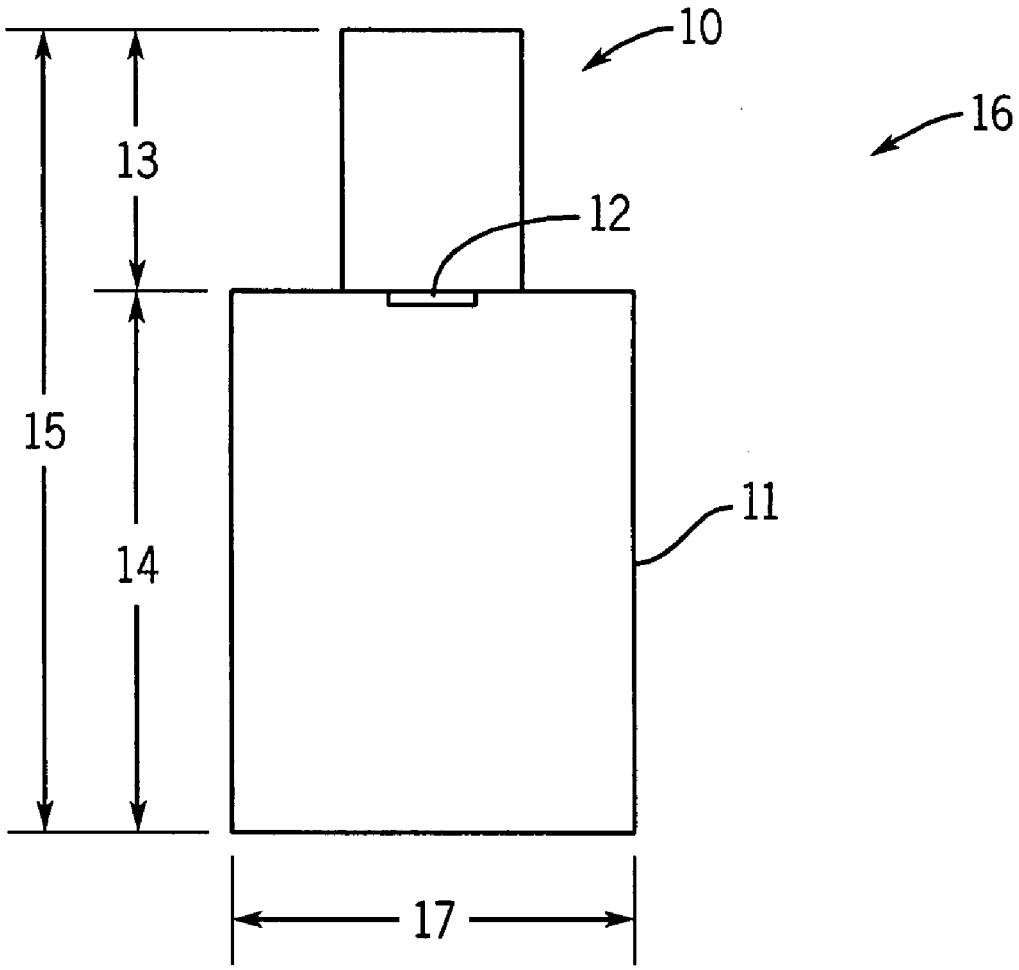
FIG. 1 (PRIOR ART)
FIG. 1 illustrates a schematic of a thermal battery and inertial igniter assembly of the prior art.
Figure 2:
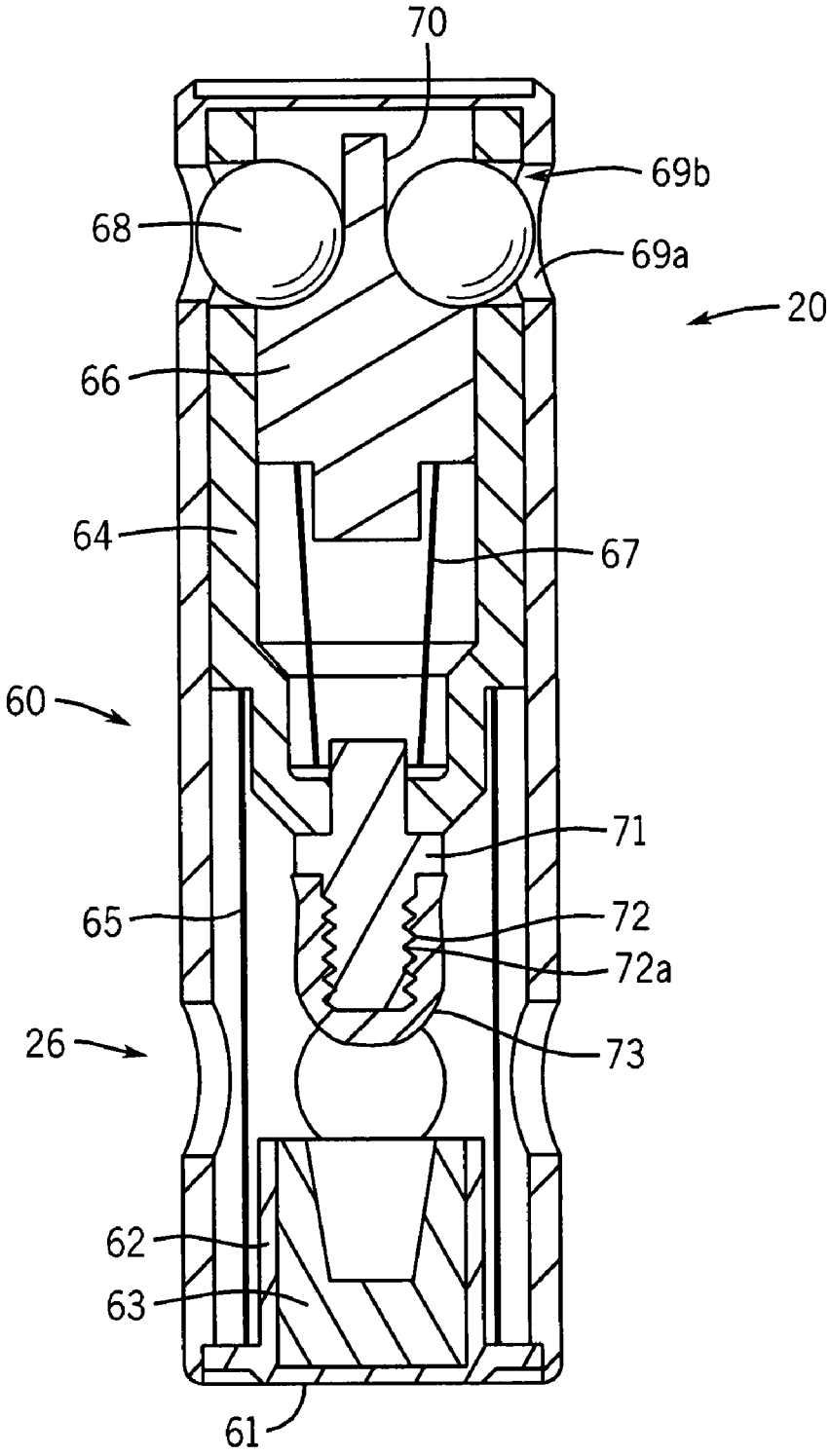
FIG. 2 (PRIOR ART)
FIG. 2 illustrates a schematic of a cross-section of an inertial igniter of the prior art
Figure 3:
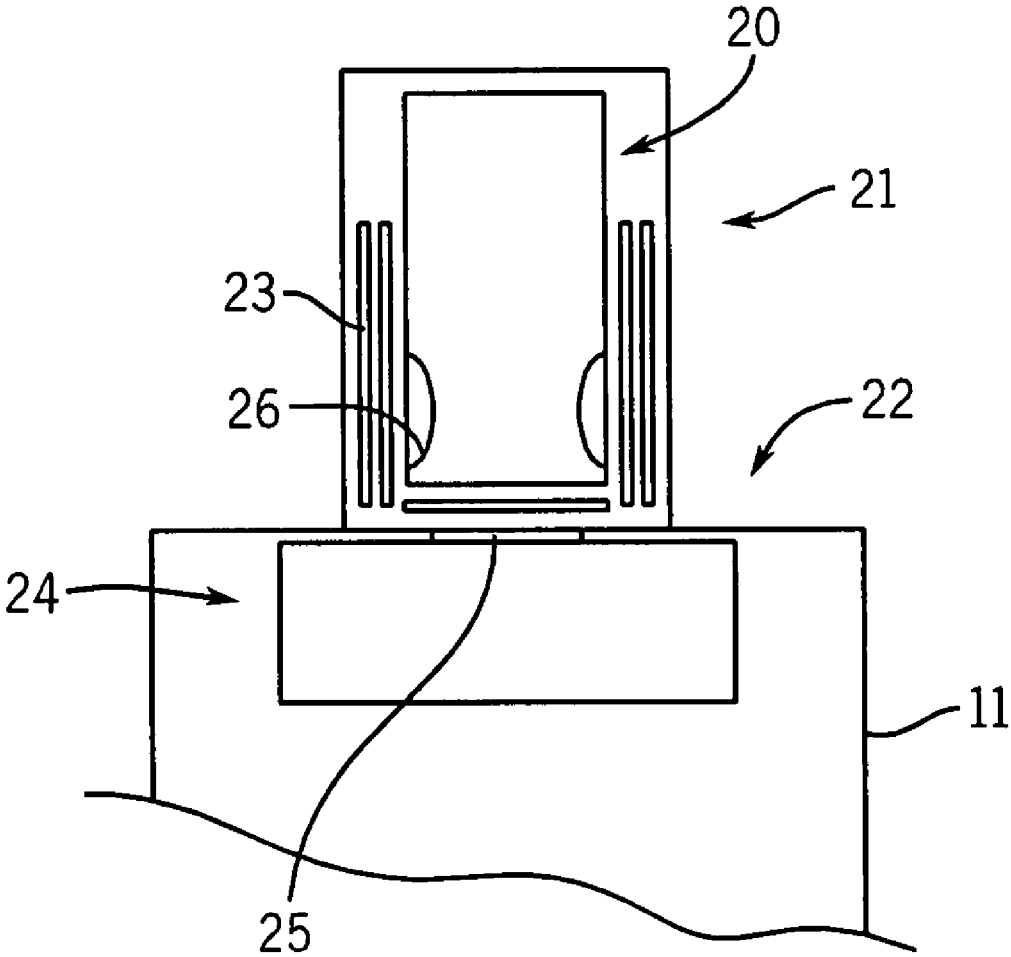
FIG. 3 (PRIOR ART)
FIG. 3 illustrates a partial schematic of the thermal battery and inertial igniter assembly of the prior art with the inertial igniter of FIG. 2 disposed therein.
Figure 4A:
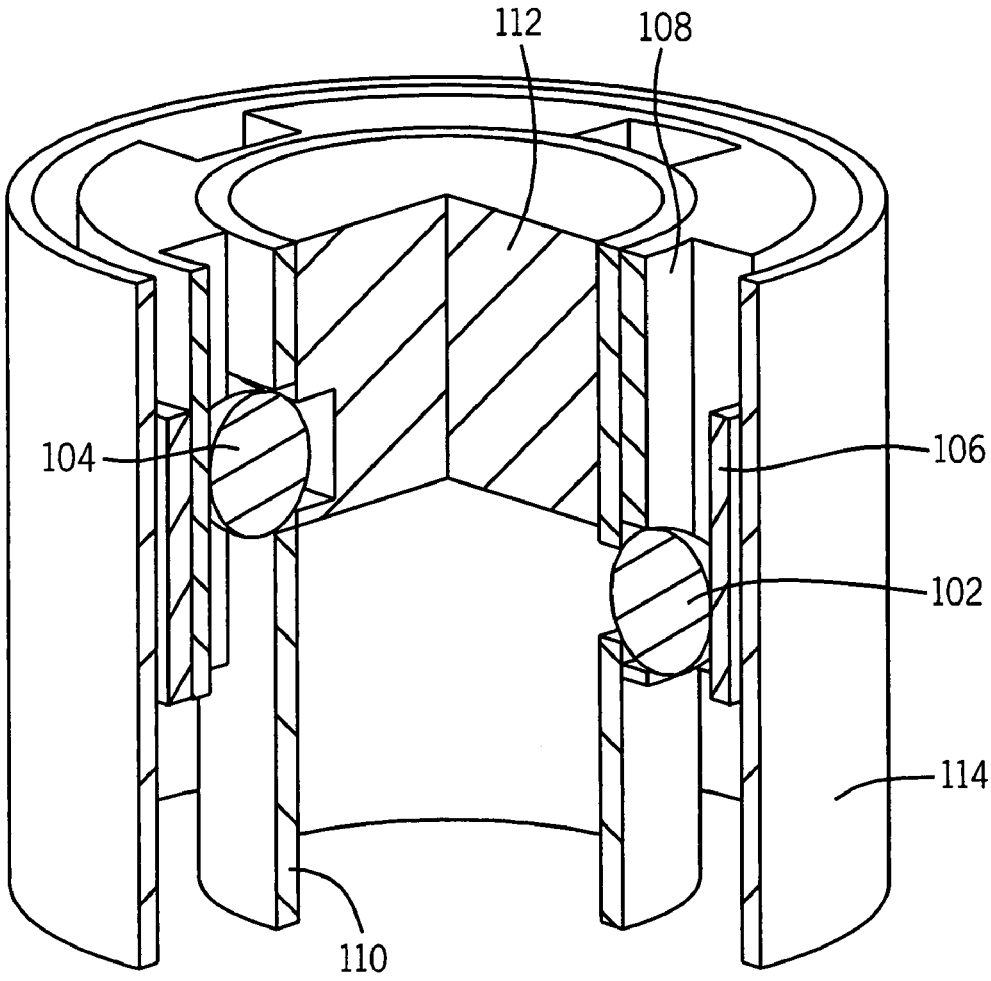
FIG. 4*a* illustrates a sectional view of an inertia igniter at rest.
Figure 4B:
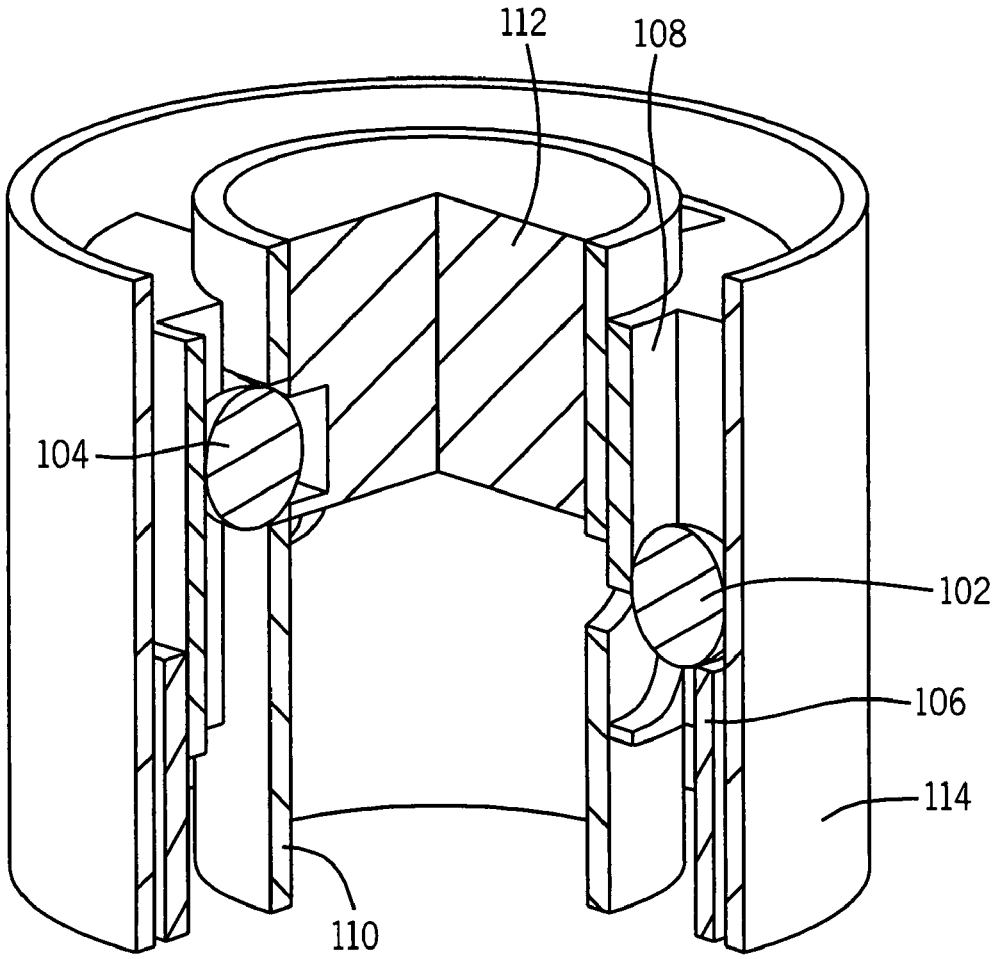
FIG. 4*b* illustrates a sectional view of the inertia igniter of FIG. 4*a* with primary safety actuated.
Figure 4C:
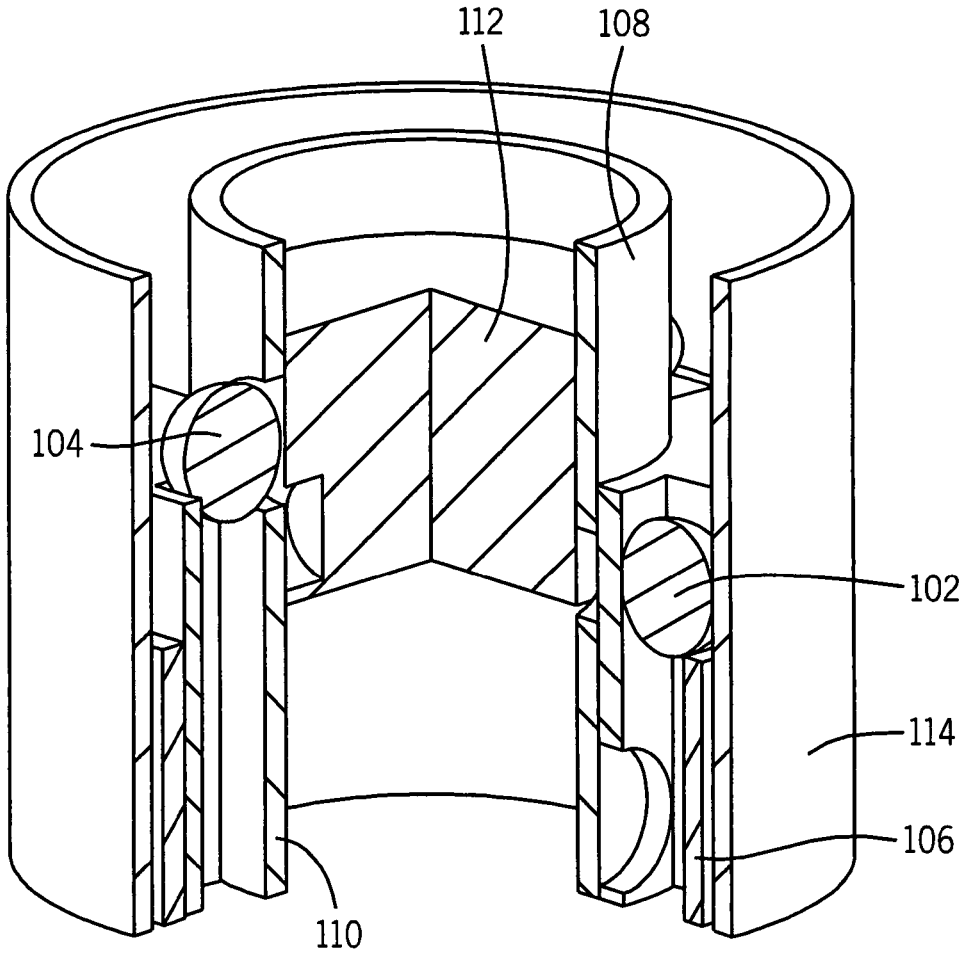
FIG. 4*c* illustrates a sectional view of the inertia igniter of FIG. 4*a* with secondary safety actuated & striker in motion.

FIGS. 4*a*-4*c* illustrate an embodiment of an inertia igniter 100 of the present invention. Given that a certain total stroke is necessary to achieve the desired fire/no-fire characteristics, the design can be implemented with very long total safety delay stroke, i.e., a very long delay time, since the total stroke is being distributed among multiple setback safety delay stages. Such an implementation would allow for reducing the overall axial length of the miniature inertial igniter. Alternately, this multi-stage design concept can be implemented to provide enhanced fire/no-fire characteristics which, if implemented in a single-stage design, would render the device impractically long in the axial direction.

The schematic of such a two stage safety delay design is shown in FIGS. 4*a*-4*c*. The inertia igniter, shown in FIG. 4*a* at rest, has primary and secondary locking balls 102, 104, primary and secondary setback collars 106, 108, a main body 110 and striker 112 all housed in an outer housing tube 114. The primary (or outer) setback collar 106 (supported by separate or integral elastic and/or damping element(s)—not shown) must fall as shown in FIG. 4*b* to release the primary and secondary locking balls 102, 104 which secure the secondary setback collar 108. Once released, the secondary setback collar 108 (again, supported by some elastic and/or damping element—not shown) falls and releases the primary and secondary locking balls 102, 104 which secure the striker 112. The striker 112 is then free to move under the influence of the remaining acceleration event toward its target as shown in FIG. 4*c*. The locking elements themselves, illustrated as balls, could be of any convenient geometry, and could furthermore be integrated into the collars themselves as flexure or break-away elements.

Because the two stages of locking elements occupy common cross-sectional volume along the axis of the device, the outside diameter of the housing tube can be nearly equal to that of a single stage design. This, combined with the potential reduction of axial length, will surely reduce the total volume occupied by the igniter compared to a single stage design.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. An inertia igniter comprising:

a housing; and a movable striker supported in the housing by first and second stages;

the first stage acting as a first time delay and being movable in the housing to only release the second stage when subjected to an acceleration having a duration above a first elapsed time;

when the first elapsed time is reached, the second stage acting as a second time delay and being movable in the housing to only release the movable striker when the duration of the acceleration is above a second elapsed time, the second elapsed time being greater than the first elapsed time; and when the second elapsed time is reached, the second stage being movable in the housing to release the movable striker.

2. A method for a time delay between an acceleration and actuation of a movable striker, the method comprising:

moving a first stage when a duration of the acceleration is above a first elapsed time to release a second stage;

when the first elapsed time is reached, moving the second stage when the duration of the acceleration is above a second elapsed time to release a movable striker, the second elapsed time being greater than the first elapsed time; and when the second elapsed time is reached, moving the movable striker.

* * * * *